US010697656B2

(12) United States Patent
Ediger et al.

(10) Patent No.: US 10,697,656 B2
(45) Date of Patent: Jun. 30, 2020

(54) AIR CIRCULATOR WITH VEIN CONTROL SYSTEM

(71) Applicant: Vornado Air, LLC, Andover, KS (US)

(72) Inventors: Glen W. Ediger, North Newton, KS (US); Gary Israel, Andover, KS (US); Brian M. Cartwright, Wichita, KS (US); Gregory Pease, Andover, KS (US); Timothy Holub, Cheney, KS (US)

(73) Assignee: Vornado Air, LLC, Andover, KS (US)

( * ) Notice: Subject to any disclaimer, the term of this patent is extended or adjusted under 35 U.S.C. 154(b) by 87 days.

(21) Appl. No.: 15/543,669

(22) PCT Filed: Mar. 3, 2016

(86) PCT No.: PCT/US2016/020790
§ 371 (c)(1),
(2) Date: Jul. 14, 2017

(87) PCT Pub. No.: WO2016/141252
PCT Pub. Date: Sep. 9, 2016

(65) Prior Publication Data

US 2018/0003401 A1 Jan. 4, 2018

Related U.S. Application Data

(60) Provisional application No. 62/128,890, filed on Mar. 5, 2015.

(51) Int. Cl.
*F24F 7/007* (2006.01)
*F24F 13/14* (2006.01)
(Continued)

(52) U.S. Cl.
CPC ..... *F24F 7/007* (2013.01); *F04D 17/04* (2013.01); *F04D 25/10* (2013.01); *F04D 29/444* (2013.01);
(Continued)

(58) Field of Classification Search
CPC ..... F24F 7/007; F24F 13/14; F24F 13/1413; F24F 13/15; F24F 13/18; B60H 1/34;
(Continued)

(56) References Cited

U.S. PATENT DOCUMENTS 2,224,312 A * 12/1940 O'Day ..... F24F 13/06 454/320
5,063,833 A * 11/1991 Hara ..... B60H 1/345 454/152
(Continued)

FOREIGN PATENT DOCUMENTS

CN 1727764 A * 2/2006
CN 102713125 A * 10/2012 ..... E06B 7/09
(Continued)

OTHER PUBLICATIONS

Chinese search report for corresponding CN 2016800123352 dated Apr. 26, 2019 (Year: 2019).*
(Continued)

*Primary Examiner* — Richard A Edgar
*Assistant Examiner* — Topaz L. Elliott

(57) ABSTRACT

The present invention is related in general to air circulators, and in particular, to an air circulator with a vein control system to direct and adjust airflow patterns. According to an exemplary embodiment, the present invention provides adjustable, vertical veins that are attached to the outlet of a tower fan. According to a preferred embodiment, the veins are pivotally mounted in such a way that by turning a knob, the veins can either be directed into a focused air-flow
(Continued)

pattern or adjusted to a divergent air-flow pattern, or at any setting in between.

11 Claims, 17 Drawing Sheets

(51) Int. Cl.

| | |
|---|---|
| ***F24F 1/0025*** | (2019.01) |
| ***F24F 1/0287*** | (2019.01) |
| ***F04D 29/44*** | (2006.01) |
| ***F04D 17/04*** | (2006.01) |
| ***F04D 25/10*** | (2006.01) |

(52) U.S. Cl.
CPC ..... *F24F 1/0025* (2013.01); *F24F 1/0287* (2019.02); *F24F 13/1413* (2013.01); *F05B 2250/314* (2013.01); *F05B 2250/315* (2013.01); *F05B 2250/323* (2013.01); *F05B 2250/324* (2013.01); *F05B 2260/506* (2013.01)

(58) Field of Classification Search
CPC . B60H 1/345; B60H 1/3421; F05B 2250/323; F05B 2250/324; F04D 29/44; F04D 29/46; F04D 29/462; F04D 29/4206; F04D 29/4226; F04D 25/08; F04D 25/10; F04D 17/04
See application file for complete search history.

(56) References Cited

U.S. PATENT DOCUMENTS 5,080,002 A * 1/1992 Soethout ..... B60H 1/00871 454/154
5,092,518 A * 3/1992 Tomioka ..... F24H 3/0488 236/10
5,324,164 A * 6/1994 Doering ..... F03B 17/067 415/150
5,470,276 A * 11/1995 Burnell ..... B60H 1/345 454/155
5,520,579 A * 5/1996 Saida ..... B60H 1/345 454/155
5,690,550 A * 11/1997 Mikowski ..... B60H 1/345 454/155
6,120,372 A * 9/2000 Riello ..... F24F 1/0011 454/233
6,800,023 B2 * 10/2004 Demerath ..... F24F 13/15 454/155
7,827,810 B2 * 11/2010 Hur ..... F24F 1/0007 62/126
9,758,020 B2 * 9/2017 Oe ..... B60H 1/34
9,878,596 B2 * 1/2018 Ross ..... B60H 1/34
2011/0294413 A1 * 12/2011 Perella ..... F04D 25/10 454/322
2018/0304725 A1 * 10/2018 Araujo Nieto ..... B60H 1/3421

FOREIGN PATENT DOCUMENTS

DE 102004004427 A1 * 9/2005 ..... B60H 1/345
DE 102005037748 B3 * 2/2007 ..... B60H 1/3421
EP 1867507 A1 * 12/2007 ..... B60H 1/345
JP 2002293133 A * 10/2002 ..... B60H 1/3421
JP 2008209043 A * 9/2008
JP 2013167414 A * 8/2013
WO WO-2014020952 A1 * 2/2014 ..... B60H 1/34

OTHER PUBLICATIONS

Chinese First Office Action for corresponding CN 2016800123352 dated May 7, 2019 (Year: 2019).*

* cited by examiner

Front View

Right Front View

Right Side View

Right Rear View

Rear View

Partial Left Rear View

Left Side View

Left Front View

Bottom View

Top View

AIR CIRCULATOR WITH VEIN CONTROL SYSTEM

RELATED APPLICATIONS

The present application claims priority to PCT Application. No. PCT/US2016/020790 filed Mar. 3, 2016, which claims priority to U.S. Provisional Application No. 62/128,890 filed Mar. 5, 2015.

FIELD OF INVENTION

The present invention is related in general to air circulators, and in particular, to an air circulator with a vein control system to direct and adjust airflow patterns.

BACKGROUND OF THE INVENTION

The cross-flow tower fan air moving device is well known in the art. Typically, in a vertically oriented cross-flow blower, air is drawn through the blower from one side and directed out through air exits on an adjacent side. Due to the aerodynamic principles that are well known in the art, the exit air is fairly laminar as it exists in a vertically oriented pattern from the fan housing. The laminar flows created by conventional tower fan designs are very effective at directing a steady flow of air in a given direction. However, conventional fan designs do not allow for manipulating the airflow to create a variety of desired air flow patterns.

Based on the foregoing, the present invention provides an improved fan design which can direct channeled air to create a variety of air flow patterns. The present invention overcomes the short coming of the prior art by accomplishing this critical objective.

SUMMARY OF THE DISCLOSURE

To minimize the limitations found in the prior art, and to minimize other limitations that will be apparent upon the reading of the specifications, the preferred embodiment of the present invention provides adjustable, vertical veins that are attached to the outlet of a tower fan. According to a preferred embodiment, the veins of the present invention are pivotally mounted in such a way that by turning a knob, the veins can either be directed into a focused air-flow pattern or adjusted to a divergent air-flow pattern, or at any setting in between.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
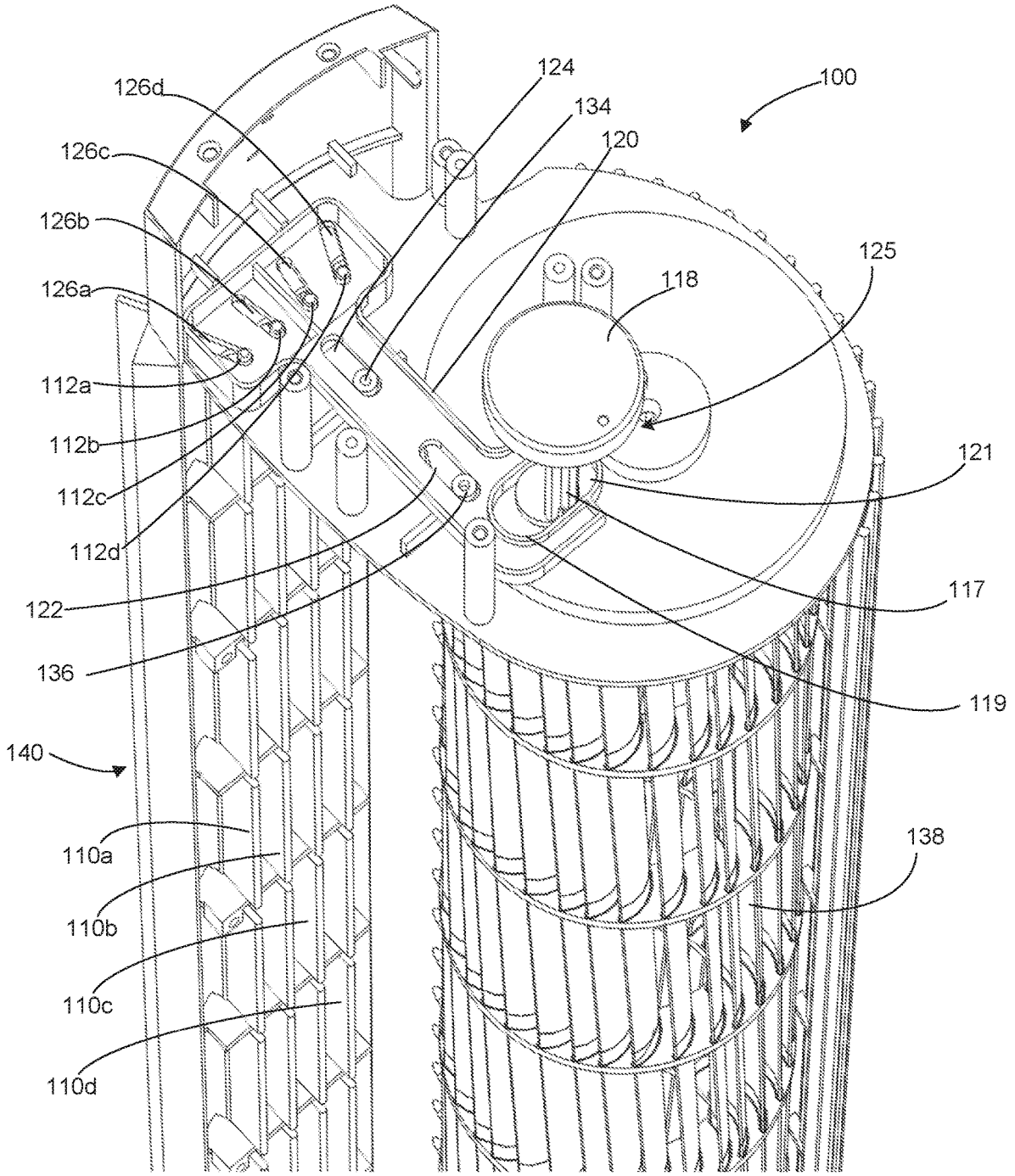
FIG. 1 shows a perspective view of the interior of a fan assembly in accordance with a first preferred embodiment of the present invention in which the veins are in a divergent configuration and the slider mechanism is in a forward position.

FIG. 1 illustrates a perspective view of the interior of an air tower circulator 100 in accordance with a first preferred embodiment of the present invention. As shown, the exemplary air tower circulator 100 includes a vertical air blower 138 which directs a flow of air into an air outlet portion 140. As shown, the air outlet portion 140 includes a set of adjustable, pivotally mounted veins 110*a*, 110*b*, 110*c*, 110*d* which each include respective pivot pins 112*a*, 112*b*, 112*c* and 112*d*. As further shown in FIG. 1, veins 110*a*-110*d* are operatively connected to a sliding mechanism 120 by having pivot pins 112*a*-112*d* respectively engaged into angled slots 126*a*, 126*b*, 126*c* and 126*d*.

As further shown in FIG. 1, the sliding mechanism 120 is preferably guided by a front post 134 secured into a front slide slot 124; and a rear post 136 secured into a rear slide slot 122. Preferably, the front post 134 and rear post 136 are affixed to a secure, stationary part of the larger fan body. Additionally, sliding mechanism 120 preferably further includes a large slot 119 running perpendicular to the slide slots 122, 124 to provide engagement with a cam mechanism 125, in operation, the cam mechanism 125 preferably rotates about an axis that is attached to an eccentric circular shaped cam lobe 121. Preferably, rotating the cam lobe 121 about the axis provides a front to back motion of the sliding mechanism 120 along the two slide slots 122, 124.

Figure 2:
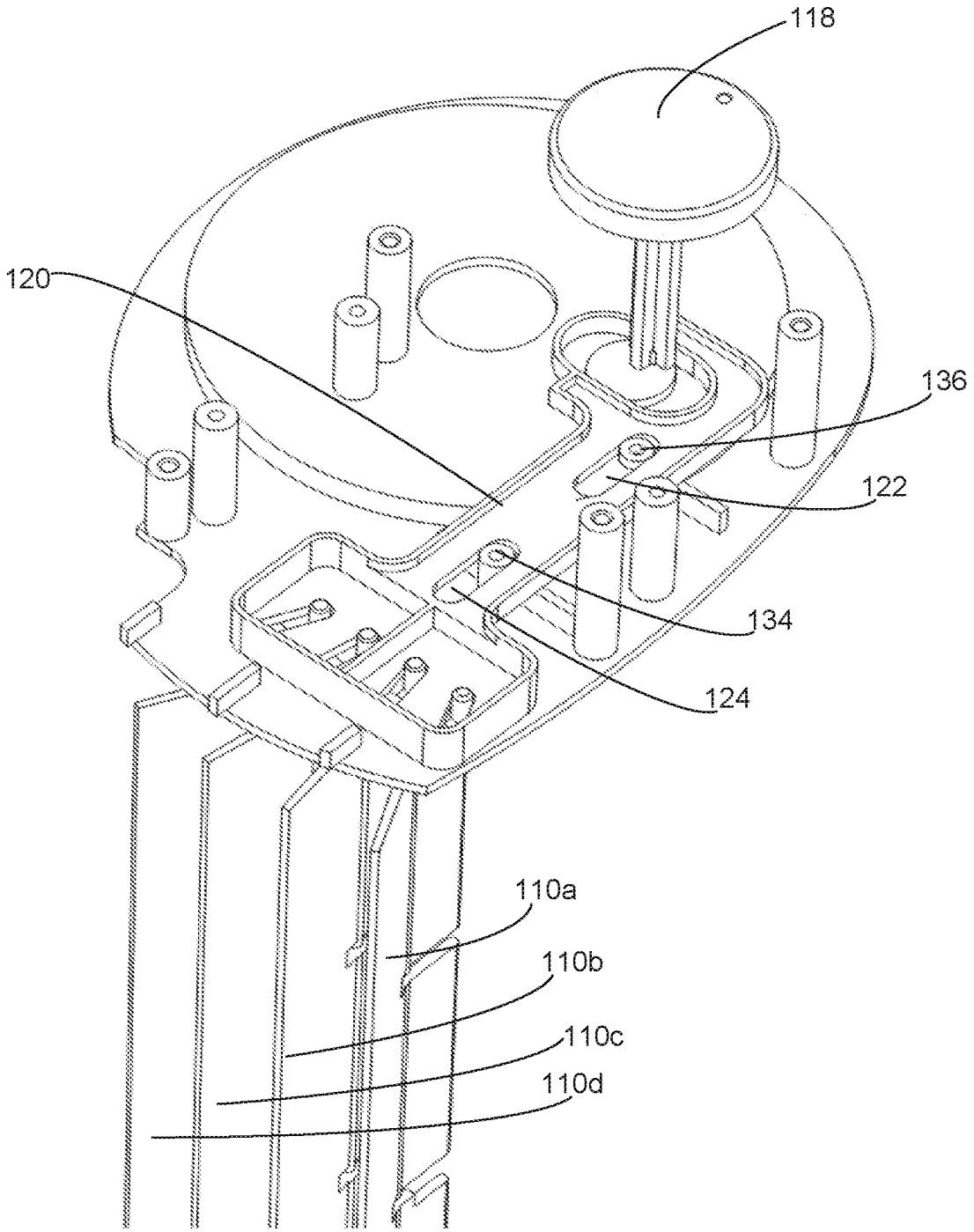
FIG. 2 shows a perspective view of the interior of a fan assembly in accordance with a first preferred embodiment of the present invention in which veins are in a divergent configuration and the slider mechanism is in a forward position.
Figure 3:
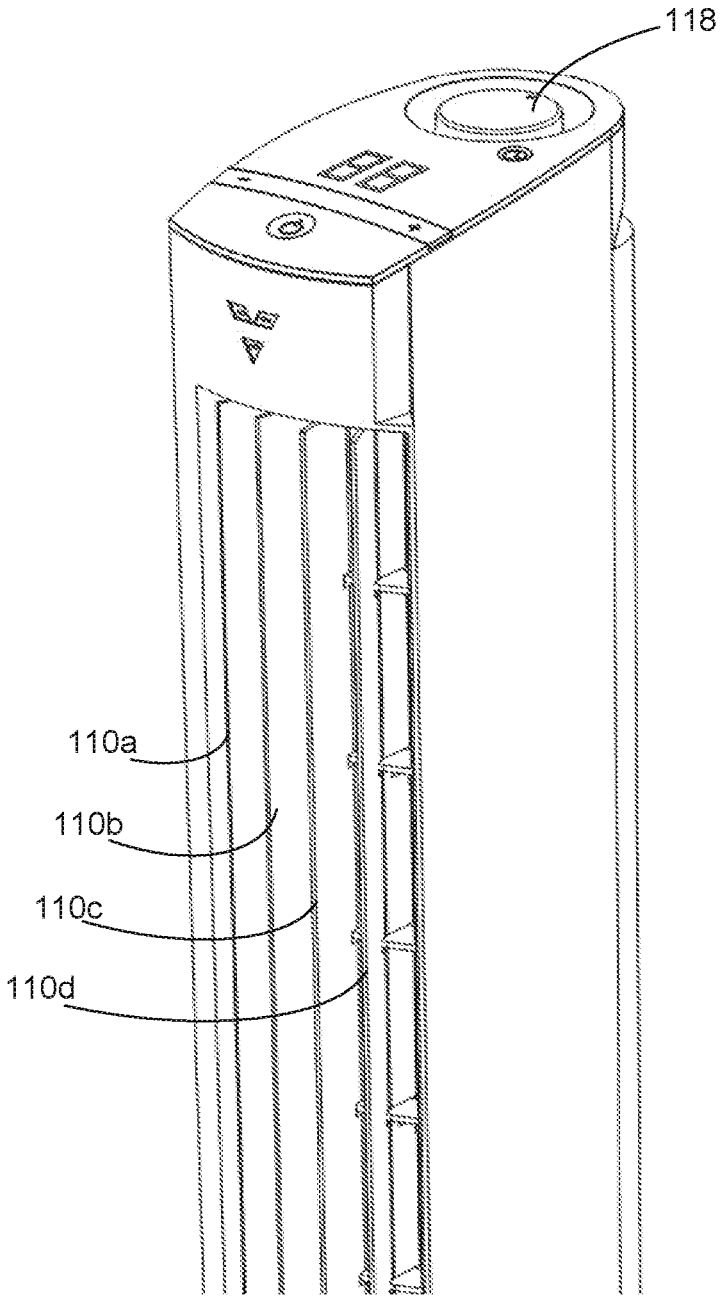
FIG. 3 shows a perspective view of a fan assembly in accordance with a first preferred embodiment of the present invention in which the knob is in a forward, disperse position and the veins are in a divergent configuration.
Figure 4:
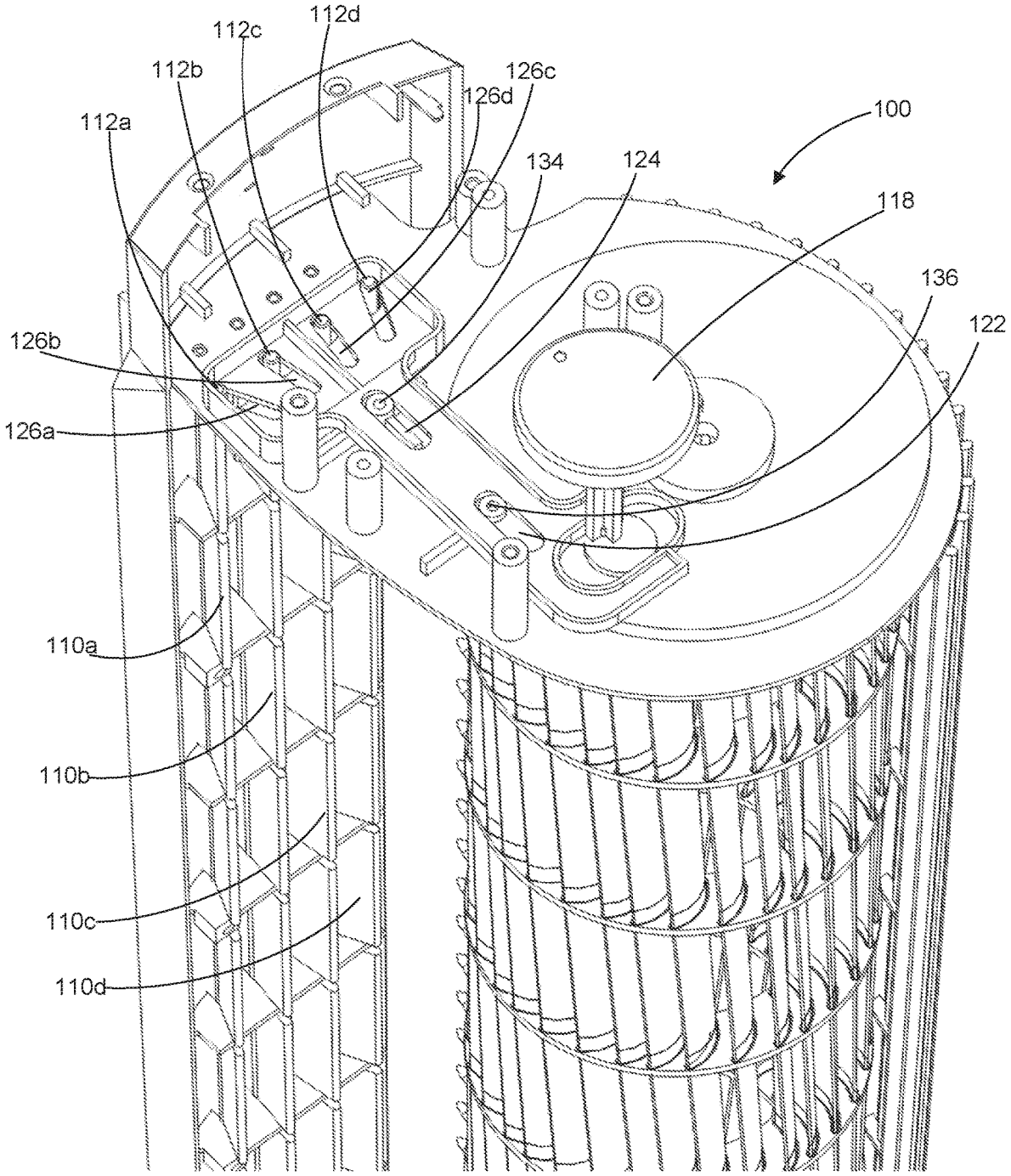
FIG. 4 shows a perspective view of a fan assembly in accordance with a first preferred embodiment of the present invention in which the veins are in a focused configuration and the slider mechanism is in the back position.
Figure 5:
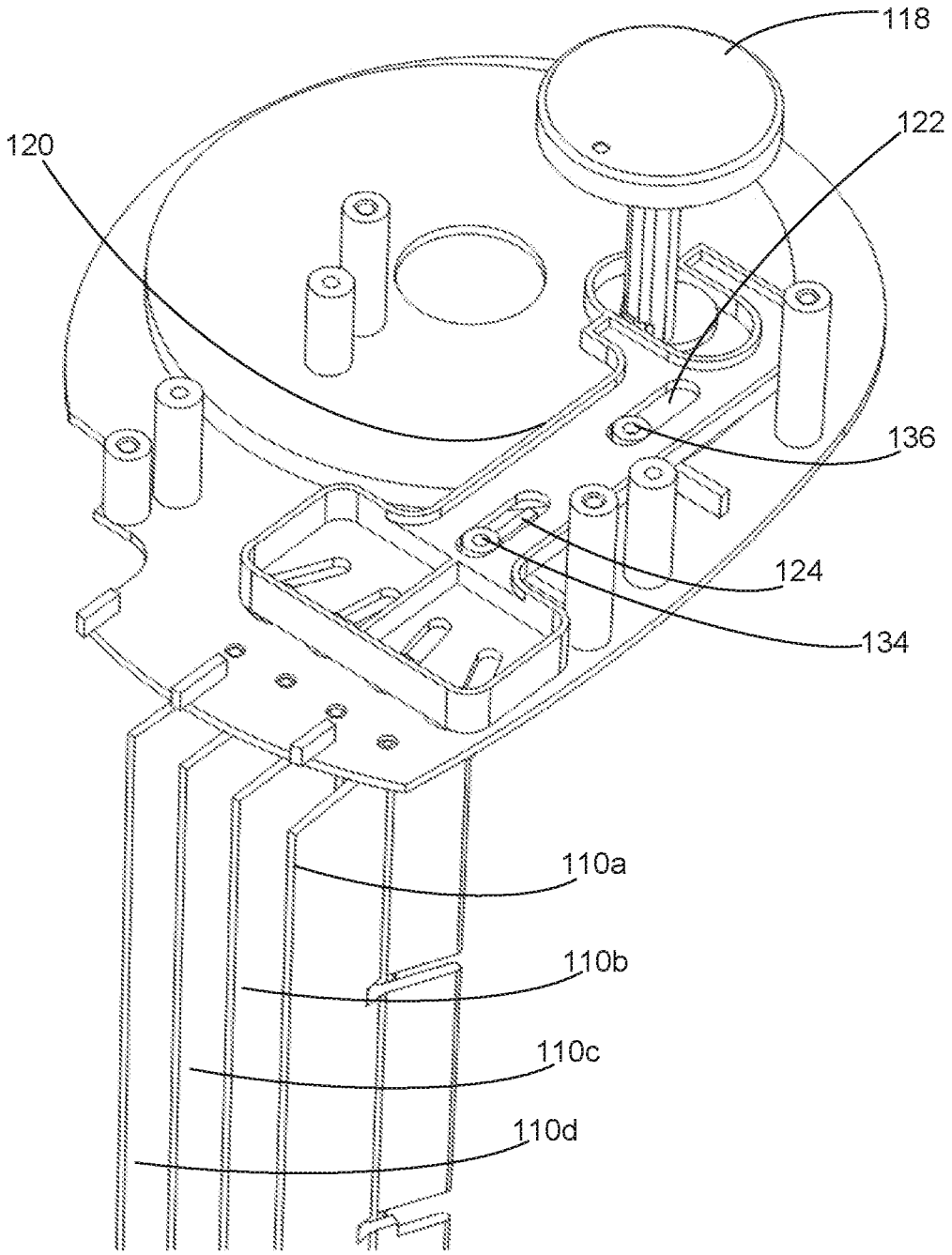
FIG. 5 shows a perspective view of a fan assembly in accordance with a first preferred embodiment of the present invention in which the veins are in a focused configuration and the slider mechanism is in the back position.
Figure 6:
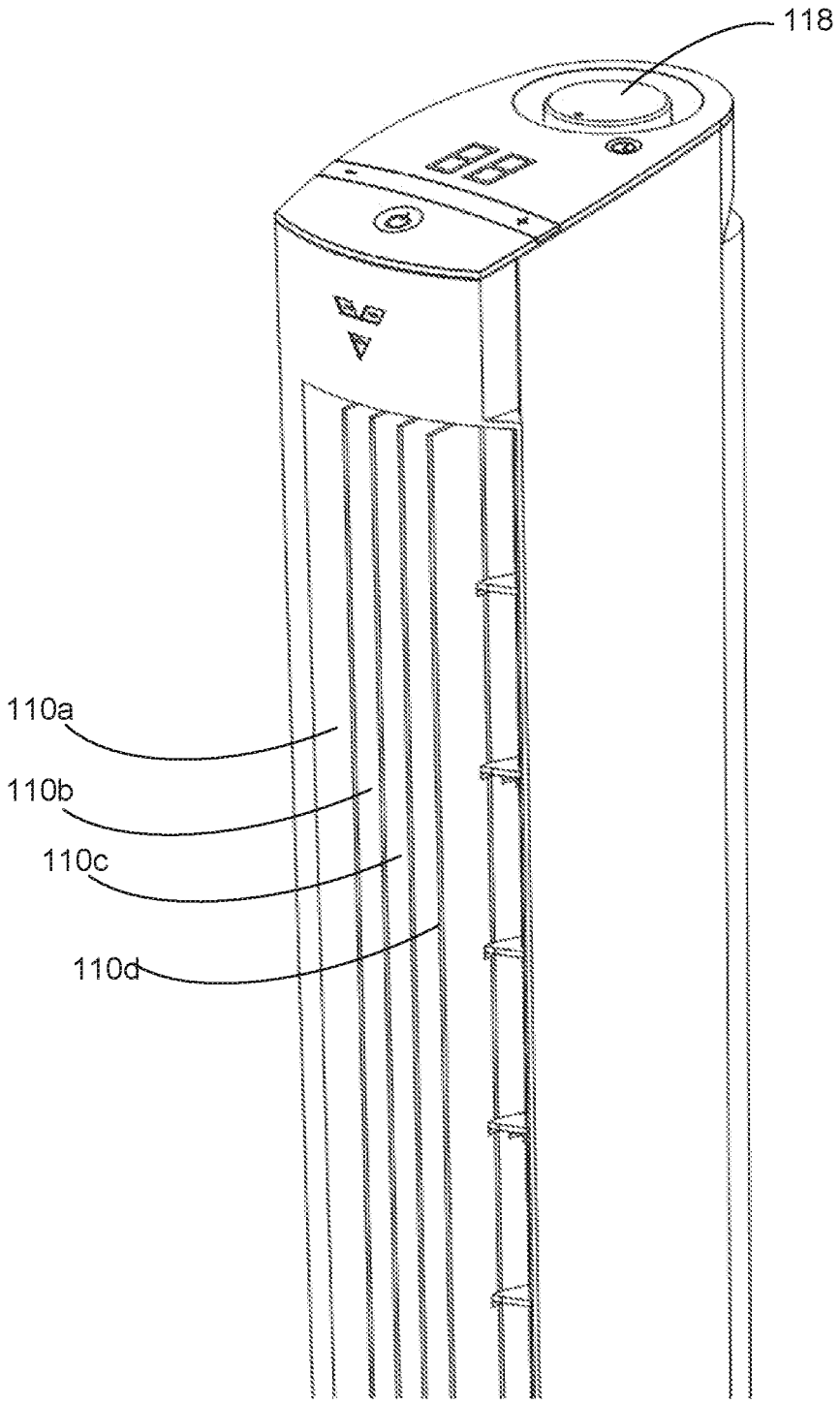
FIG. 6 shows a perspective view of a fan assembly in accordance with a first preferred embodiment of the present invention in which the veins are in a focused position.

According to a further preferred embodiment, the cam lobe 121 may be circular in shape and preferably fitted to contain the sliding mechanism 120 from moving either forward or backwards, and to keep the veins 110*a*-110*d* in the desired position. As further shown, the cam lobe 121 is preferably activated by a knob 118 which is attached to the cam lob 121 via cam stem 117 which aligned with the pivot axis of the cam lobe 121. Accordingly, rotating the knob 118 in either direction will preferably cause the sliding mechanism 120 to move forward or back and thereby move the veins 110*a*-110*d* from a divergent position as shown in FIGS. 1-3) to a convergent position (as shown in FIGS. 4-6) or any stopping point desired in-between. Alternatively, the sliding mechanism 121 may be adjusted directly without the use of the cam mechanism 125.

Figure 7:
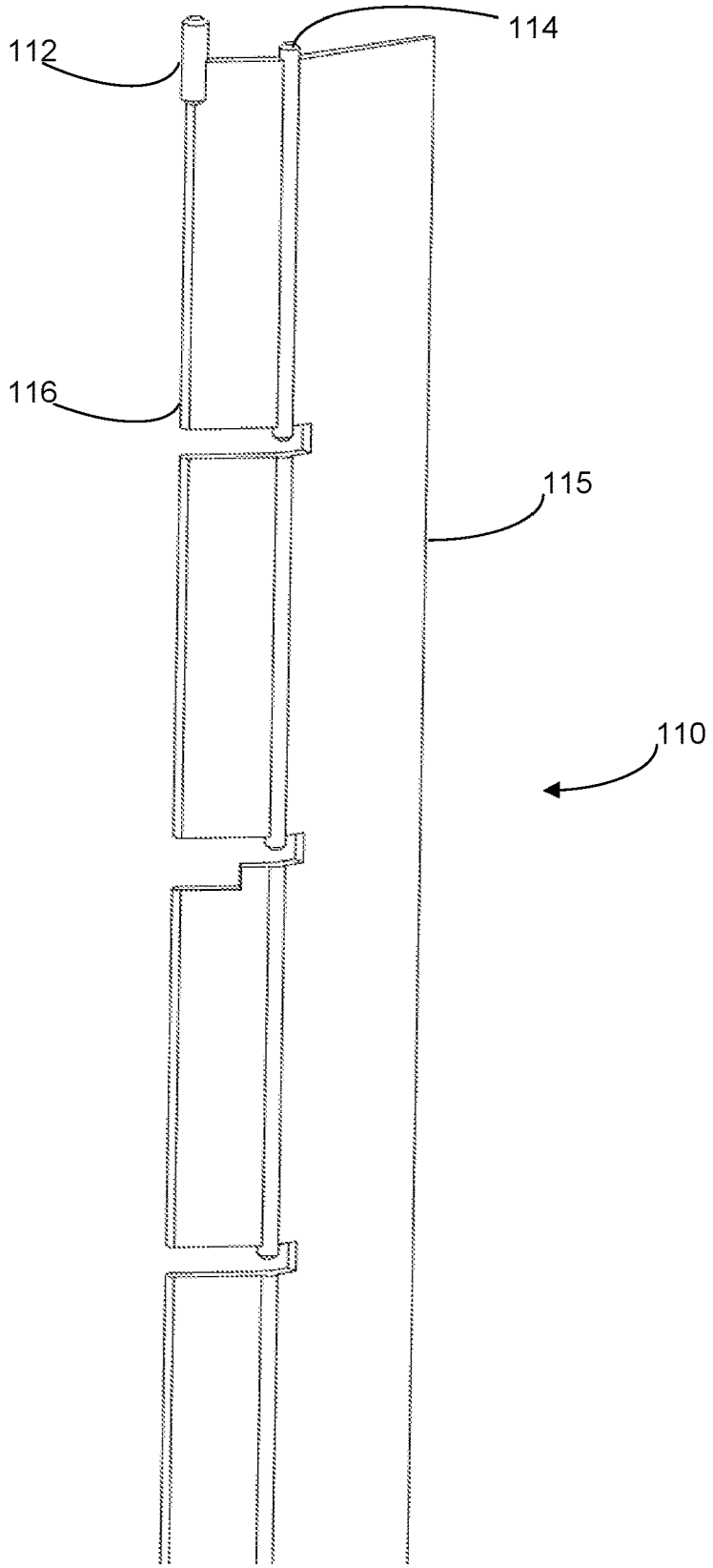
FIG. 7 shows a perspective view of a single vein assembly with a pivot pin in accordance with a first preferred embodiment of the present invention.
Figure 8:
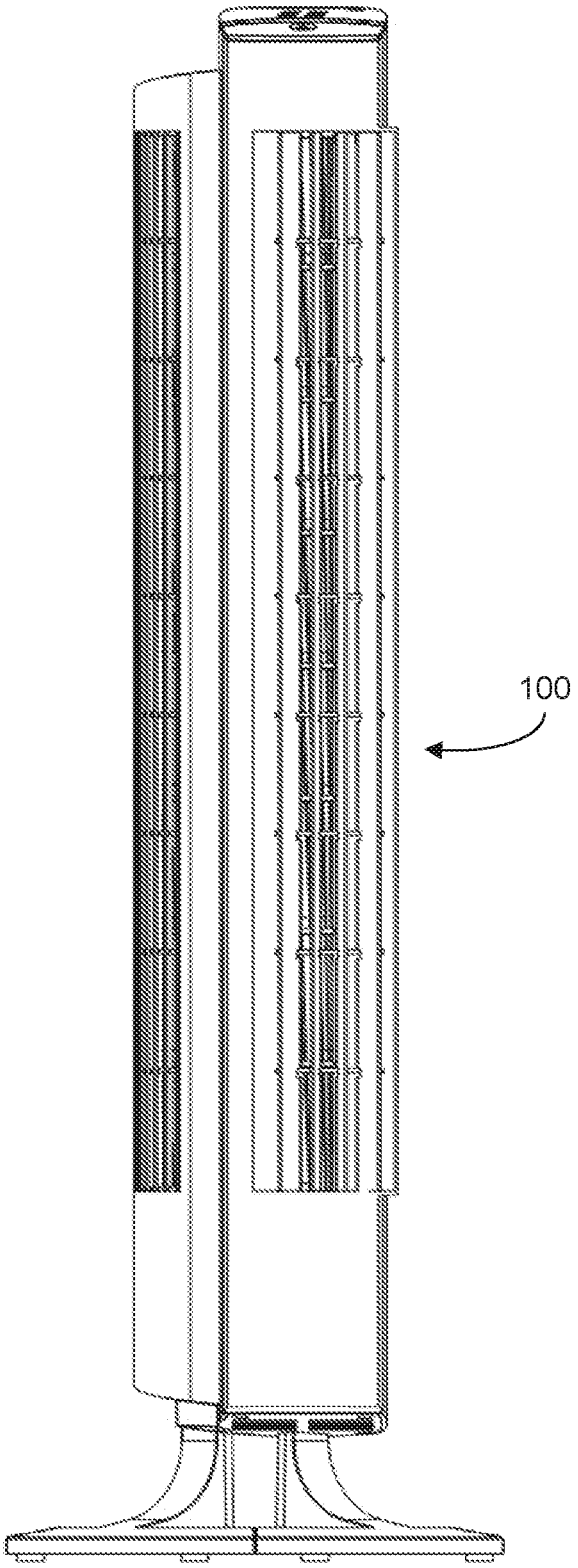
FIG. 8 shows a front view of a fan tower of the present invention in accordance with a first preferred embodiment of the present invention.
Figure 9:
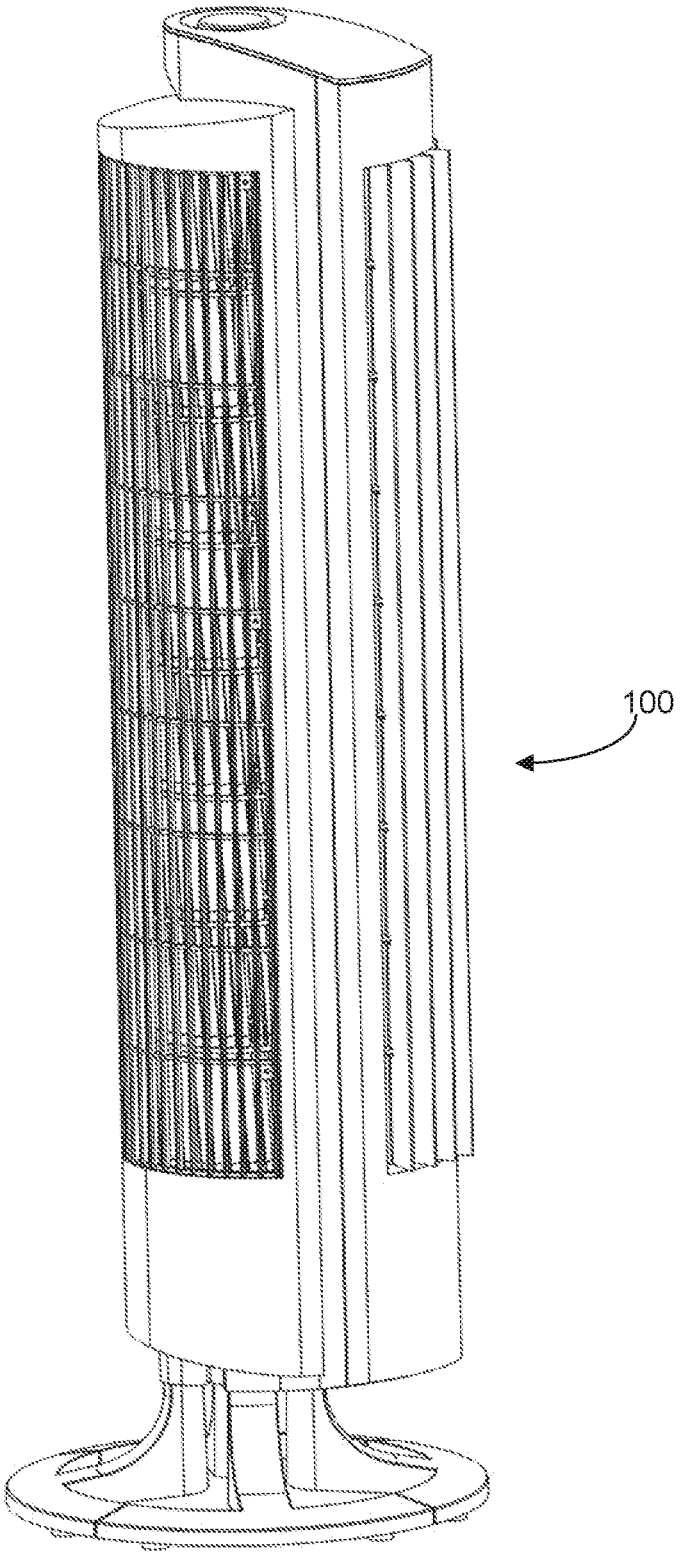
FIG. 9 shows a right front view of a fan tower in accordance with a first preferred embodiment of the present invention.
Figure 10:
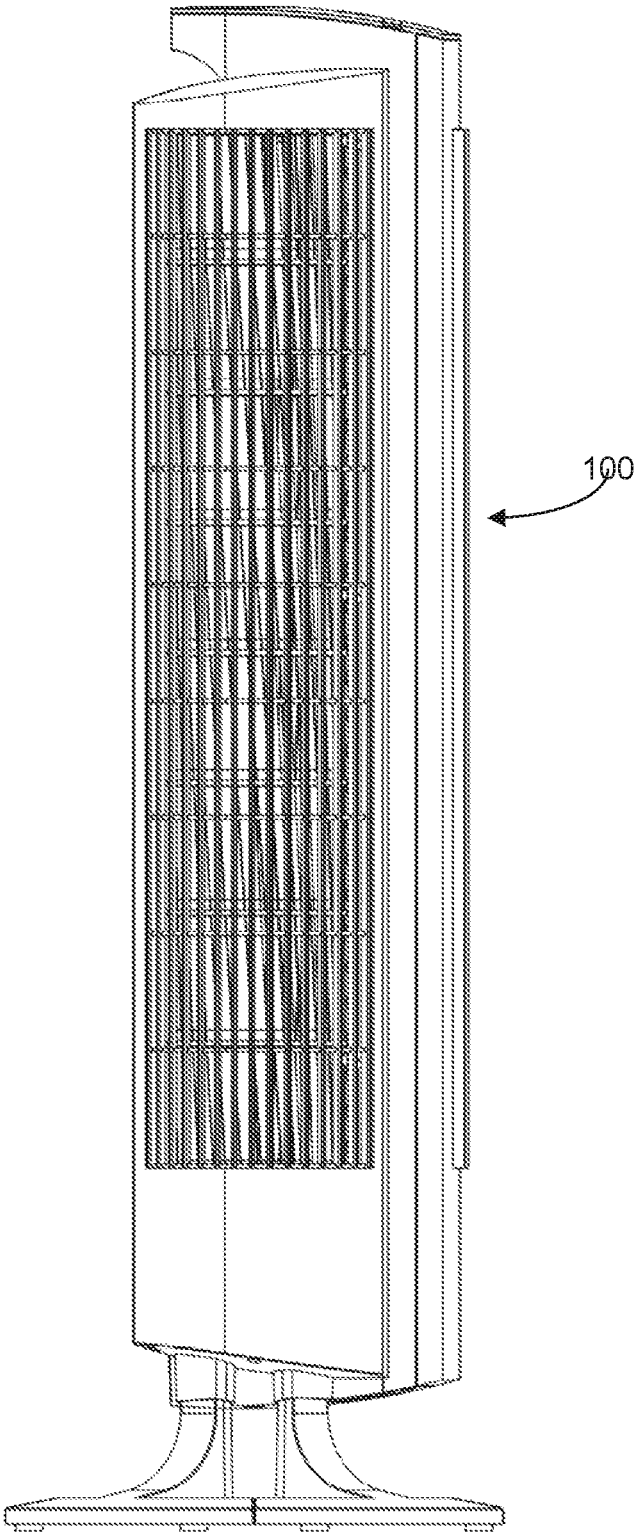
FIG. 10 shows a right side view of a fan tower in accordance with a first preferred embodiment of the present invention.
Figure 11:
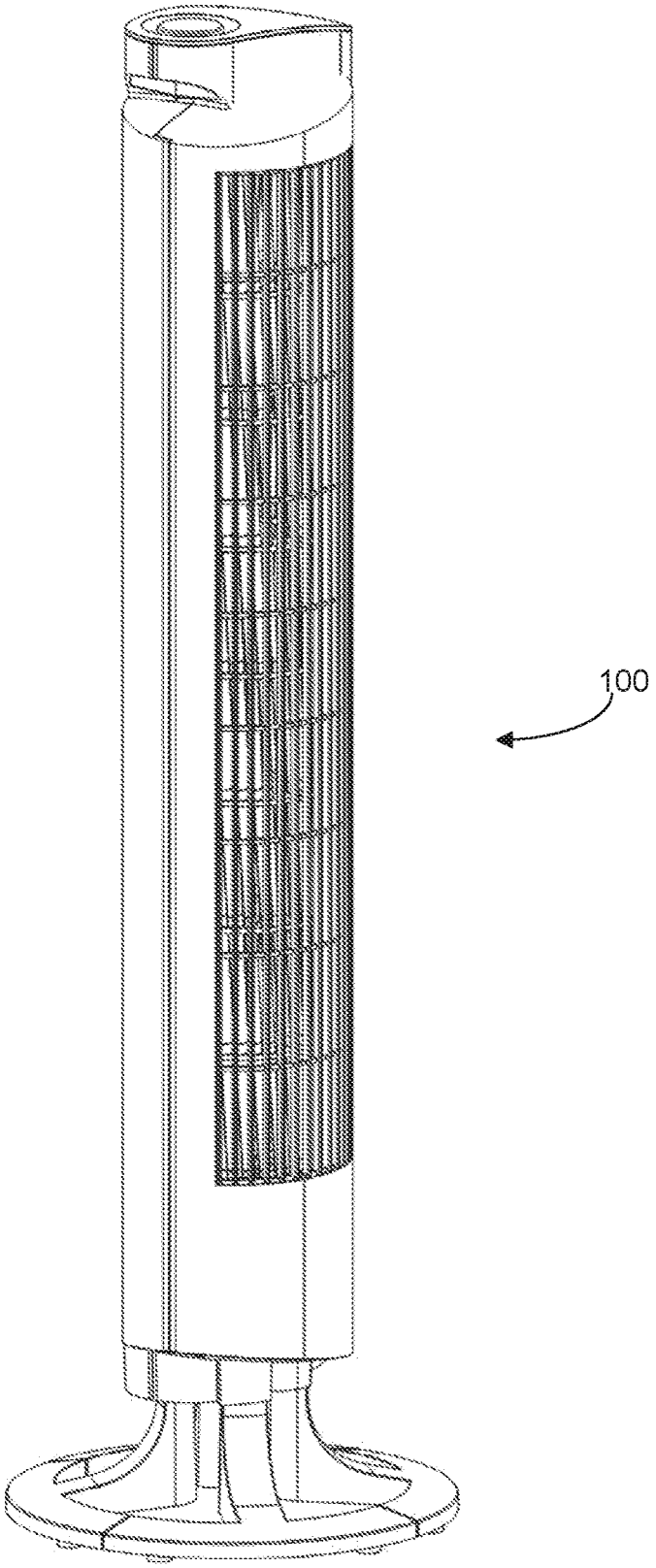
FIG. 11 shows a right rear view of a fan tower in accordance with a first preferred embodiment of the present invention.
Figure 12:
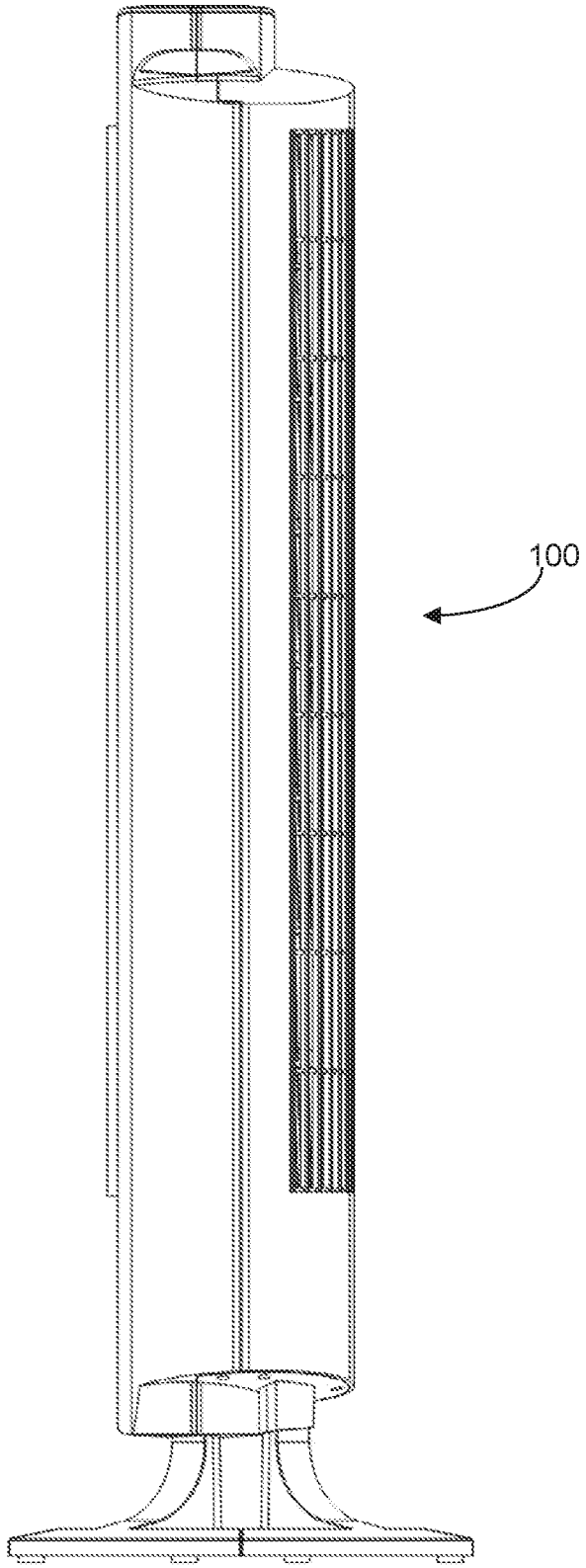
FIG. 12 shows a rear view of a fan tower in accordance with a first preferred embodiment of the present invention.
Figure 13:
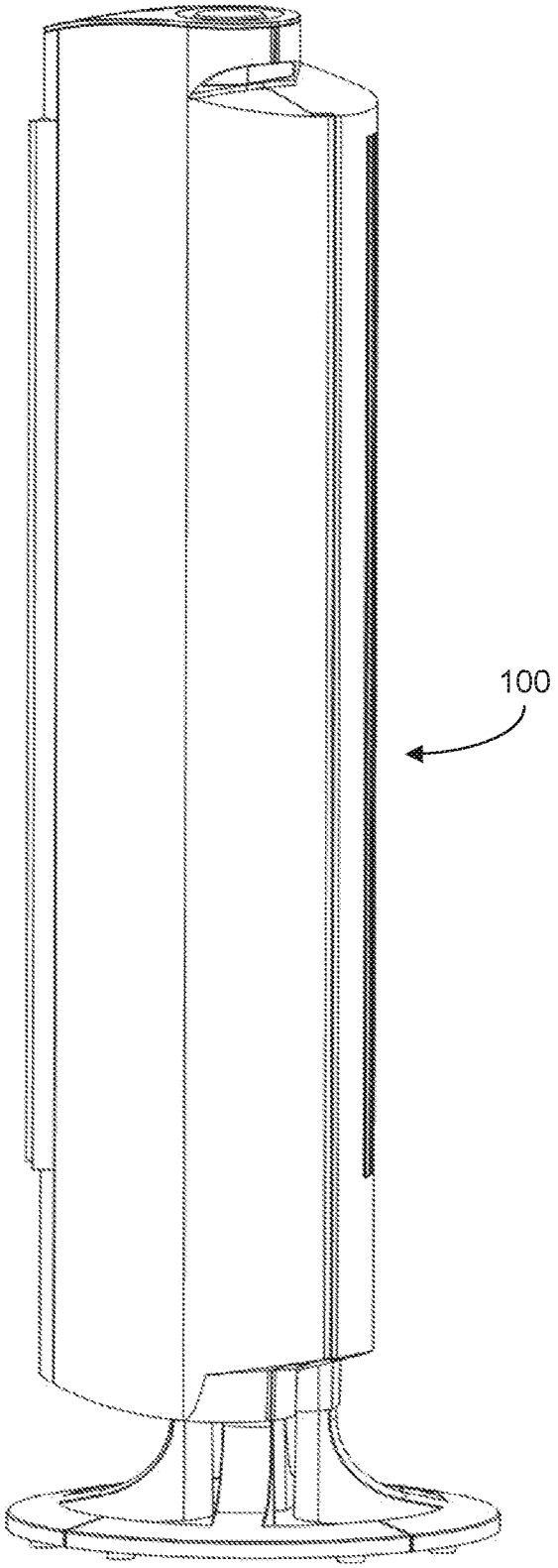
FIG. 13 shows a partial left rear view of a fan tower in accordance with a first preferred embodiment of the present invention.
Figure 14:
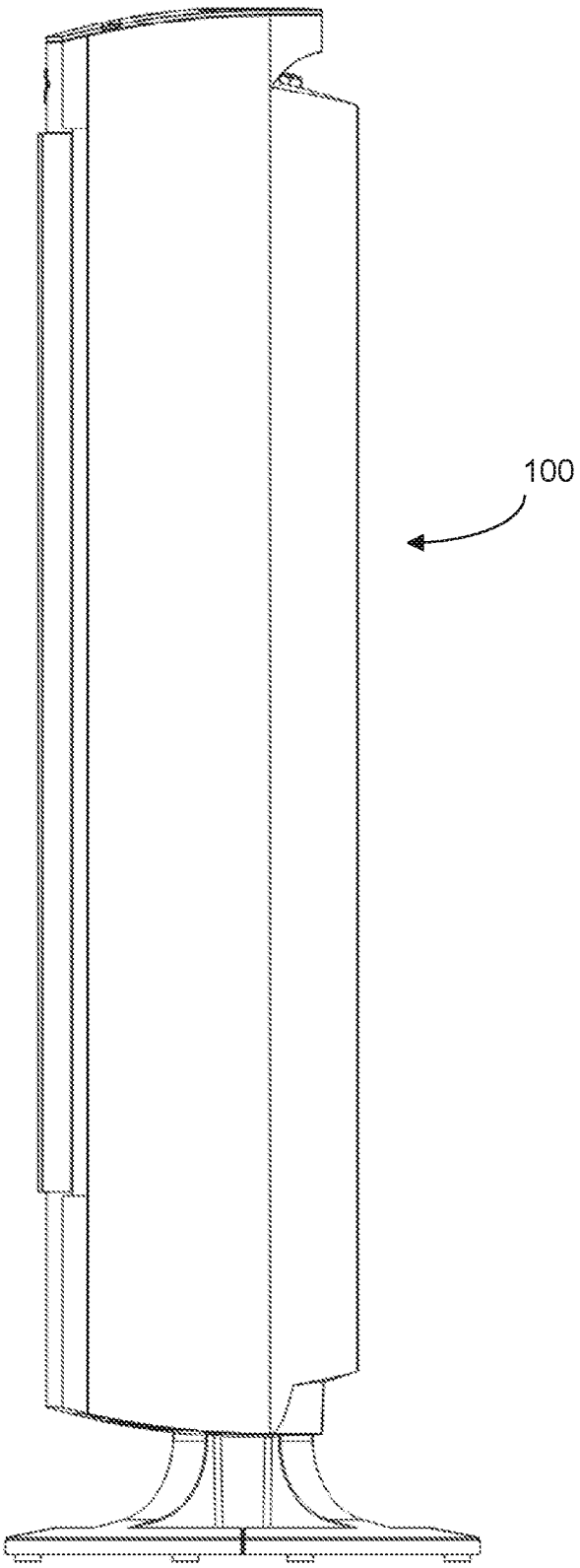
FIG. 14 shows a left side view of a fan tower in accordance with a first preferred embodiment of the present invention.
Figure 15:
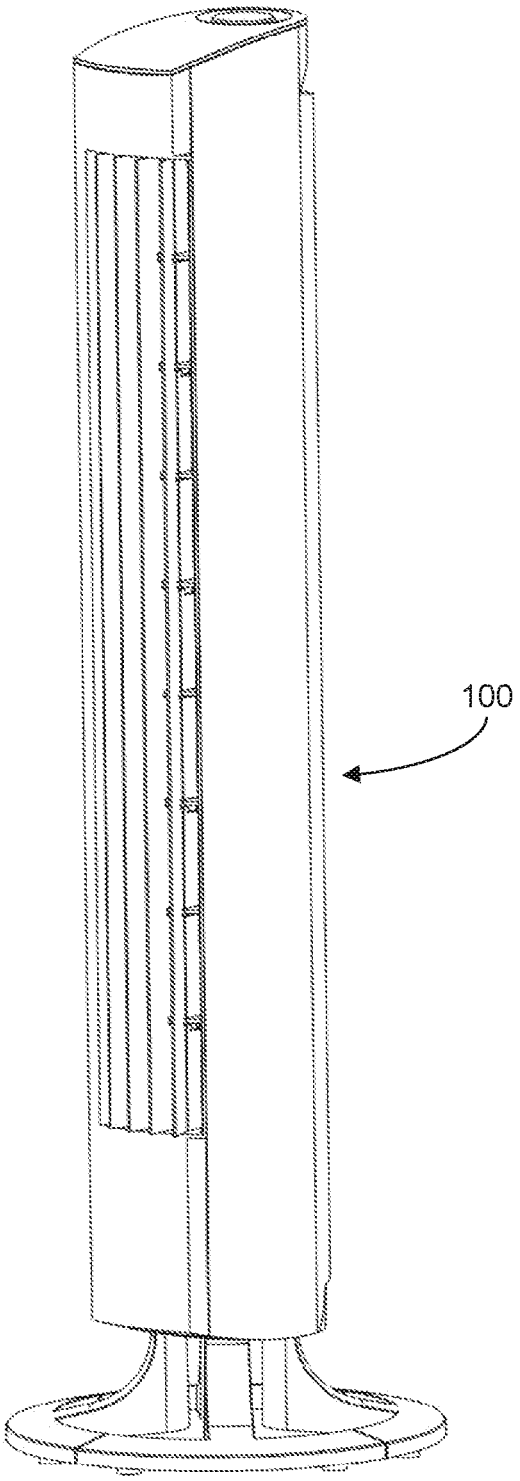
FIG. 15 shows a left front view of a fan tower in accordance with a first preferred embodiment of the present invention.
Figure 16:
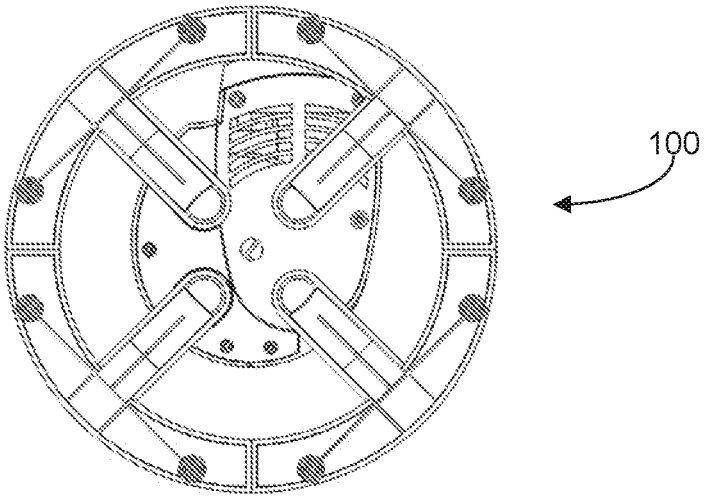
FIG. 16 shows a bottom view of a fan tower in accordance with a first preferred embodiment of the present invention.
Figure 17:
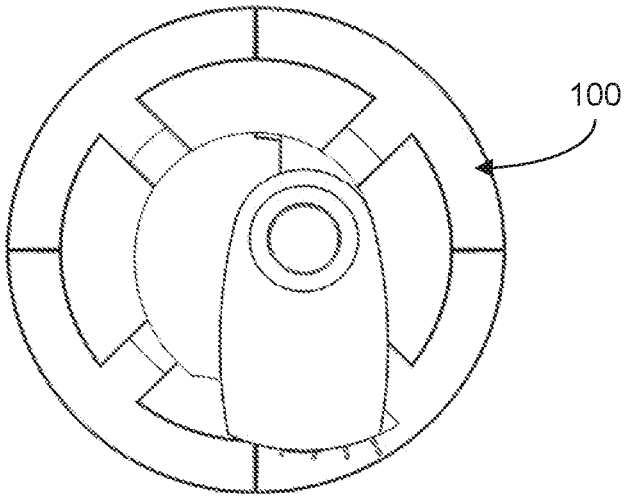
FIG. 17 shows a top view of a fan tower in accordance with a first preferred embodiment of the present invention.

With reference now to FIG. 7, an exemplary vein 110 for use with the present invention is further illustrated (the terms "vein" and "vane" are used interchangeably herein). As shown, the exemplary vein 110 preferably includes upstream, vertical ribs 116 and a downstream portion 115. According to a preferred embodiment, the vertical ribs 116 preferably include an additional pivot pin 112 designed to fit into an angled slot (i.e. one of slots 126*a*-126*d* shown in FIG. 1). As discussed below, vein 110 further includes an axis 114 about which the veins can be pivoted to direct air flow. According to a further aspect of the present invention, vein 110 may be made of an injection molded plastic and may be molded-in, in the form of multiple pivot points. According to the present invention, the pivot points 114 of the vein are preferably secured into top and bottom members (not shown) and may further include multiple sub-divided supports in-between.

According to alternative embodiments, the veins may be designed in various cross-sectional configurations, including aerodynamic air-foil shapes, rectangular shapes, or bent shapes, such as a dogleg bend (as illustrated in the preferred embodiment) or gentle curves. Advantageously, when the veins are configured in a dog-leg (bent) cross section design and moved to the focused position, the upstream dog-leg bend also has the effect of nearly closing off the outer slots, and thus directs more air to the center openings resulting in an even higher air velocity, which is desirable in the focused configuration.

With reference again to FIG. 1, according to a preferred embodiment, the knob 118 preferably acts as an adjustable control to simultaneously angle the veins 110*a*-110*d* in order to focus the channels of air, or to simultaneously angle the veins to defuse the air channels. In operation, the angle, spacing, and length of the angled slots 126*a*-126*d*, in coordination with the travel length of the sliding mechanism 120, determine the amount, the direction, and the angle of the veins. In the examples shown in FIGS. 1, 2 and 3, the knob 118 is shown in a disbursement position. As shown, in this position, the sliding mechanism 120 has been pushed forward causing the pivot pins 112*a*-112*d* to travel upwards within their respective angled slots 126*a*-126*d*, thereby moving the veins 110*a*-110*d* to a divergent configuration which disburses the channels of air. Conversely, in the examples shown in FIGS. 4, 5 and 6, the knob 118 is shown turned to a focusing position. In this position, the sliding mechanism 120 has been pushed forward to cause the veins 110*a*-110*d* to narrow to a focusing configuration, which focuses the channels of air.

In accordance with alternative preferred embodiments, there may be any number of veins used, from one to several. Further, although four vertically oriented veins are shown in the preferred configuration, other vein orientations may include horizontal or angled veins or a combination of orientations. Additionally, multiple ribs may be used with each rib having a unique shape for aerodynamic reasons. Still further, although the linkage between the veins and the sliding mechanism 120 is shown in the preferred configuration as being accomplished and controlled from the top end of the vein assembly, this linkage and control can be arranged from the bottom of the veins or from any location in-between.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An air circulation system, wherein the air circulation system comprises:

a blower; wherein the blower is vertically aligned; wherein the blower directs a laminar flow of air in a direction which is perpendicular to the vertical alignment of the blower;

a mounting platform, wherein the mounting platform is secured above the blower; wherein a first major axis of the mounting platform is aligned substantially parallel to the laminar flow of the air from the blower;

a front post and a rear post secured to the mounting platform; wherein the front post and the and rear post are arranged along a line which is parallel to the laminar flow of the air from the blower;

a vertically aligned cam system; wherein the cam system comprises a cam knob, a cam stem and a cam lobe; wherein the cam lobe is rotatably secured to the mounting platform; further wherein the cam knob is secured to the cam lobe by the vertically aligned cam stem;

an air outlet portion, wherein the air outlet portion is comprised of a plurality of vanes; wherein the vanes are vertically aligned; wherein each of the vanes is comprised of a plurality of upstream ribs and at least one downstream rib; wherein the upstream ribs and the at least one downstream rib are joined at a center axis; wherein the upstream ribs are aligned in a first direction; wherein the at least one downstream rib is aligned in a second direction which is offset from the first direction;

wherein each of the plurality of vanes further comprises at least one pivot pin;

a slide mechanism, wherein the slide mechanism comprises:

an upper slot, wherein the upper slot encloses and is mechanically engaged with the cam lobe;

a body;

a front slide slot, wherein the front slide slot encloses and slidably engages with the front post;

a rear slide slot, wherein the rear slide slot encloses and slidably engages with the rear post; and a plurality of angled slots; wherein each of the angled slots is formed within the body of the slide mechanism; wherein the plurality of angled slots comprise at least a first angled slot and a second angled slot; wherein the first angled slot has a first major axis aligned in a first direction; wherein the second angled slot has a second major axis aligned in a second direction; wherein the first direction and the second directions are different directions so that lines along the first and second major axes of the first and second angled slots intersect at exactly one point;

wherein each of the pivot pins of the plurality of vanes is slidably engaged within one of the plurality of angled slots; wherein each of the pivot pins is configured to slide within one of the plurality of angled slots when the slide mechanism is horizontally translated along the upper platform in response to a horizontal translation of the cam lobe within the upper slot of the slide mechanism.

2. The air circulation system of claim 1, wherein the at least one pivot pin of each vane is attached to at least one of the plurality of upstream ribs.

3. The air circulation system of claim 1, wherein each of the angled slots has a major axis aligned in a different direction so that the lines along the major axes of any two of the angled slots intersect at exactly one point.

4. The air circulation system of claim 1, wherein the cam lobe comprises an eccentric circular shape.

5. The air circulation system of claim 1, wherein the vanes are formed of injection molded plastic.

6. The air circulation system of claim 1, wherein the cam system is configured to translate the rotational movement of the knob between a first forward position and a second rear position.

7. The air circulation system of claim 6, wherein in the first forward position, the vanes are positioned to direct the air flow from the blower in a plurality of divergent directions.

8. The air circulation system of claim 7, wherein in the second rear position, the vanes are positioned to direct the air flow from the blower in a plurality of convergent directions.

9. The air circulation system of claim 1, wherein the vanes comprise one or more curved surfaces.

10. The air circulation system of claim 1, wherein the slide mechanism is located above the plurality of vanes.

11. The air circulation system of claim 1, wherein the slide mechanism is located beneath the plurality of vanes.

* * * * *